US005561340A

United States Patent [19]

Jin et al.

[11] Patent Number: 5,561,340

[45] Date of Patent: Oct. 1, 1996

[54] FIELD EMISSION DISPLAY HAVING CORRUGATED SUPPORT PILLARS AND METHOD FOR MANUFACTURING

[75] Inventors: Sungho Jin, Millington; Gregory P. Kochanski, Dunellen; Wei Zhu, North Plainfield, all of N.J.

[73] Assignee: Lucent Technologies Inc., Murray Hill, N.J.

[21] Appl. No.: 381,262

[22] Filed: Jan. 31, 1995

[51] Int. Cl.[6] ..... H01J 1/30

[52] U.S. Cl. ..... 313/309; 313/497

[58] Field of Search ..... 313/482, 496, 313/422, 309, 336, 351, 310, 495, 497

[56] References Cited

U.S. PATENT DOCUMENTS

| | | | |
|---|---|---|---|
| 3,665,241 | 5/1972 | Spindt et al. | 313/309 |
| 4,940,916 | 7/1990 | Borel et al. | 313/306 |
| 5,063,327 | 11/1991 | Brodie et al. | 313/482 |
| 5,129,850 | 7/1992 | Kane et al. | 445/24 |
| 5,138,237 | 8/1992 | Kane et al. | 315/349 |
| 5,283,500 | 2/1994 | Kochanski | 315/58 |

OTHER PUBLICATIONS

Dec. 1991 issue of *Semiconductor International*, p. 46.

C. A. Spindt et al. "Field–Emitter Arrays for Vacuum Microelectronics," *IEEE Transactions on Electron Devices*, vol. 38, pp. 2355–2363 (1991).

I. Brodie et al, *Advances in Electronics and Electron Physics* edited by P. W. Hawkes, vol. 83, pp. 75–87 (1992).

J. A. Costellano, *Handbook of Display Technology* Academic Press, NY, pp. 254–257 (1992).

Okano et al., "Fabrication of a diamond field emitter array", *Appl. Phys. Lett*, vol. 64, p. 2742 (1994).

R. Hawley, "Solid Insulators in Vacuum" *Vacuum*, vol. 18, p. 383–390 (1968).

*Primary Examiner*—Michael Horabik
*Assistant Examiner*—Michael Day

[57] ABSTRACT

A field emission display includes corrugated insulating support pillars (96) disposed between the phosphorous layer (95) and the substrate (50) for reducing arcing between the cathode (92) and the anode (93) along the surface of the pillar. The corrugation of the insulating support pillars provides for a substantially increased operating voltage between the cathode and the anodes thereby increasing the operating life and efficiency of the field emission display.

9 Claims, 3 Drawing Sheets

FIELD EMISSION DISPLAY HAVING CORRUGATED SUPPORT PILLARS AND METHOD FOR MANUFACTURING

FIELD OF THE INVENTION

This invention relates to methods for making field emission devices and, in particular, to methods for making field emission devices, such as flat panel displays, having corrugated support pillars for breakdown resistance.

BACKGROUND OF THE INVENTION

Support pillars are important components of electron field emission devices (FEDs) such as flat panel displays. A typical field emission device comprises a cathode including a plurality of field emitter tips and an anode spaced from the cathode. A voltage applied between the anode and cathode induces emission of electrons towards the anode. In flat panel displays an additional electrode called a gate is typically disposed between the anode and cathode to selectively activate desired pixels. The space between the cathode and anode is evacuated, and integrated cylindrical support pillars keep the cathode and anode separated. Without support pillars, the atmospheric pressure outside would force the anode and cathode surfaces together. Pillars are typically 100–1000 μm high and each provides pillar support for an area of 1–10,000 pixels.

While cylindrical pillars may provide adequate mechanical support, they are not well suited for new field emission devices employing higher voltages. Applicants have determined that increasing the operating voltage between the emitting cathode and the anode can substantially increase the efficiency and operating life of a field emission device. For example, in a flat panel display, changing the operating voltage from 500 V to 5000 V could increase the operating life of a typical phosphor by a factor of 100. However, because of the close spacing between electrodes, insulator breakdown and arcing along the surface of cylindrical pillars precludes the use of such high voltages.

If a cylindrical insulator is disposed between two electrodes and subjected to a continuous voltage gradient, then emitted electrons colliding with the dielectric can stimulate the emission of secondary electrons. These secondary electrons in turn accelerate toward the positive electrode. This secondary emission can lead to a runaway process where the insulator becomes positively charged and an arc forms along the surface. Accordingly, there is a need for a new pillar design that will permit the use of higher voltages without breakdown and arcing.

SUMMARY OF THE INVENTION

In accordance with the invention, a field emission device is made by providing the device electrodes, forming a plurality of corrugated insulating rods, adhering the rods to an electrode, cutting away the tops of the rods to define corrugated pillars, and finishing the device. The corrugated rods can be formed in one of three different methods. The result is low cost production of a field emission device having superior resistance to breakdown in high voltage operation.

BRIEF DESCRIPTION OF THE DRAWING

The nature, advantages and various additional features of the invention will appear more fully upon consideration of the illustrative embodiments now to be described in detail in connection with the accompanying drawings. In the drawings.

It is to be understood that the drawings are for purposes of illustrating the concepts of the invention and are not to scale.

DETAILED DESCRIPTION

This description is divided into two parts. Part I describes fabrication of a FED device having corrugated support pillars and part II describes preferred ways of making the corrugated pillars.

I. Device Fabrication

Figure 1:
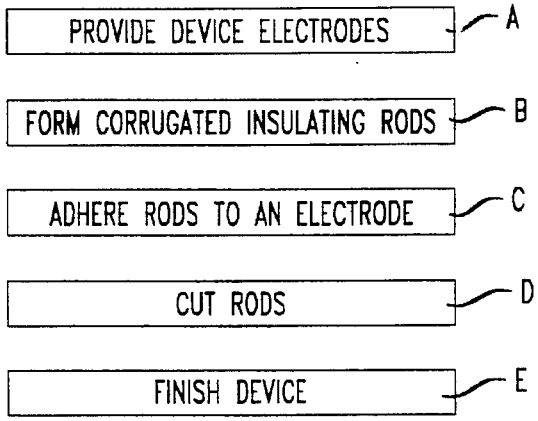
FIG. 1 is a schematic block diagram of the steps in making an electron field emission device according to the invention.

Referring to the drawings, FIG. 1 is a block diagram of the steps in making a field emission device. A preliminary step shown in Block A, is to provide the device electrodes: an emitter cathode and an anode which may include a phosphor layer. Preferably the emitter cathode uses diamond field emitters because of their low voltage emission and their robust mechanical and chemical properties. Field emitting cathodes employing diamond field emitters are described, for example, in Okano et al., Appl. Phys. Lett., Vol. 64, p. 2742 (1994) and in U. S. Pat. Nos. 5,129,850 and 5,138,237, all of which are incorporated by reference. Preferred electrodes for flat panel displays are disclosed in co-pending U.S. Patent application Ser. No. 08/220,077 filed by Eom et at. on Mar. 30, 1994; and the following applications filed by Jin et at: Ser. No. 08/299674 (Aug. 31, 1994); Ser. No. 08/299470 (Aug. 31, 1994); Ser. No. 08/331458 (Oct. 31, 1994); Ser. No. 08/332179 (Oct. 31, 1994); and Ser. No. 08/361616 (Dec. 22, 1994).

The next step (FIG. 1, Block B) is to form a plurality of corrugated insulating rods to be used as support pillars separating the emitter cathode from an anode.

There are five considerations in optimal pillar design. First, the optimal pillar design is one where the height of the pillar is short in order to minimize the divergence of emitted electrons, while the length of surface paths from negative to positive electrodes are as long as possible in order to reduce the likelihood of insulator breakdown. Second, it is desirable to construct the pillar so that most secondary electrons will re-impact the pillar Surface close to the point of their generation, rather than being accelerated a substantial distance toward the positive electrode. This goal is advantageous because most materials generate less than one secondary electron for each incident electron if the incident energy is less than 500 V (or preferably, less than 200 V). Under these conditions, secondary electrons will generally not have enough energy to make an increasing number of secondaries of their own. For the purposes of this goal, "close" is defined as a point where the electrostatic potential is less than 500 V more positive than the point at which the electron is generated, and preferably less than 200 V more positive. Third, it is desirable to construct the pillar out of dielectric materials that have secondary electron emission coefficients of less than two, under the normal operating conditions. Fourth, it is desirable to have as much of the surface of the pillar oriented so that the local electric field is nearly normal to the insulator surface, preferably with the field lines emerging from the surface, so that secondary electrons will be pulled back toward the surface and re-impact with energies less than the abovementioned 200–500 V. Fifth, the pillar must not be so much wider at the anode end so that it substantially reduces the area that can be allocated to the phosphor screen.

Where the field emission device is a flat panel display, the pillar material should not only be mechanically strong but also should be an electrical insulator with a high breakdown voltage in order to withstand the high electrical field applied to operate the phosphor of the display. For established phosphors such as ZnS:Cu, A1, the breakdown voltage should be greater than about 2000 V and preferably greater than 4000 V.

A suitable pillar material may be chosen from glasses such as lime glass, pyrex, fused quartz, ceramic materials such as oxide, nitride, oxynitride, carbide (e.g., $A1_2O_3$, $TiO_2$, $ZrO_2$, A1N), polymers (e.g., polyimide resins) or composites of ceramics, polymers, or metals.

A typical geometry of the pillar is advantageously a modified form of either round or rectangular rod. The diameter or thickness of the pillar is typically 50–1000 μm, and preferably 100–300 μm. The height-to-diameter or height-to-thickness aspect ratio of the pillar is typically in the range of 1–10, preferably in the range of 3–6. The desired number or density of the pillars is dependent on various factors to be considered. For sufficient mechanical support of the anode plate, a larger number of pillars is desirable, however, in order to minimize expense, electrical leakage, and the possibility of breakdown, some compromise is necessary. A typical density of the pillar is about 0.01–2% of the total display surface area, and preferably 0.05–0.5%. A FED display of about 25×25 $cm^2$ area with approximately 500–100,000 pillars, each with a cross-sectional area of 100×100 $\mu m^2$ is a good example.

Since the breakdown of the dielectric properties in the pillar occurs most frequently at its surface, it is desirable to increase the surface length of the pillar between the cathode and the anode. The surface distance is increased by introducing corrugations—either annular or helical—in the pillar rod. The corrugations are advantageously formed in one of three ways described hereinafter in Part II.

Figure 2:
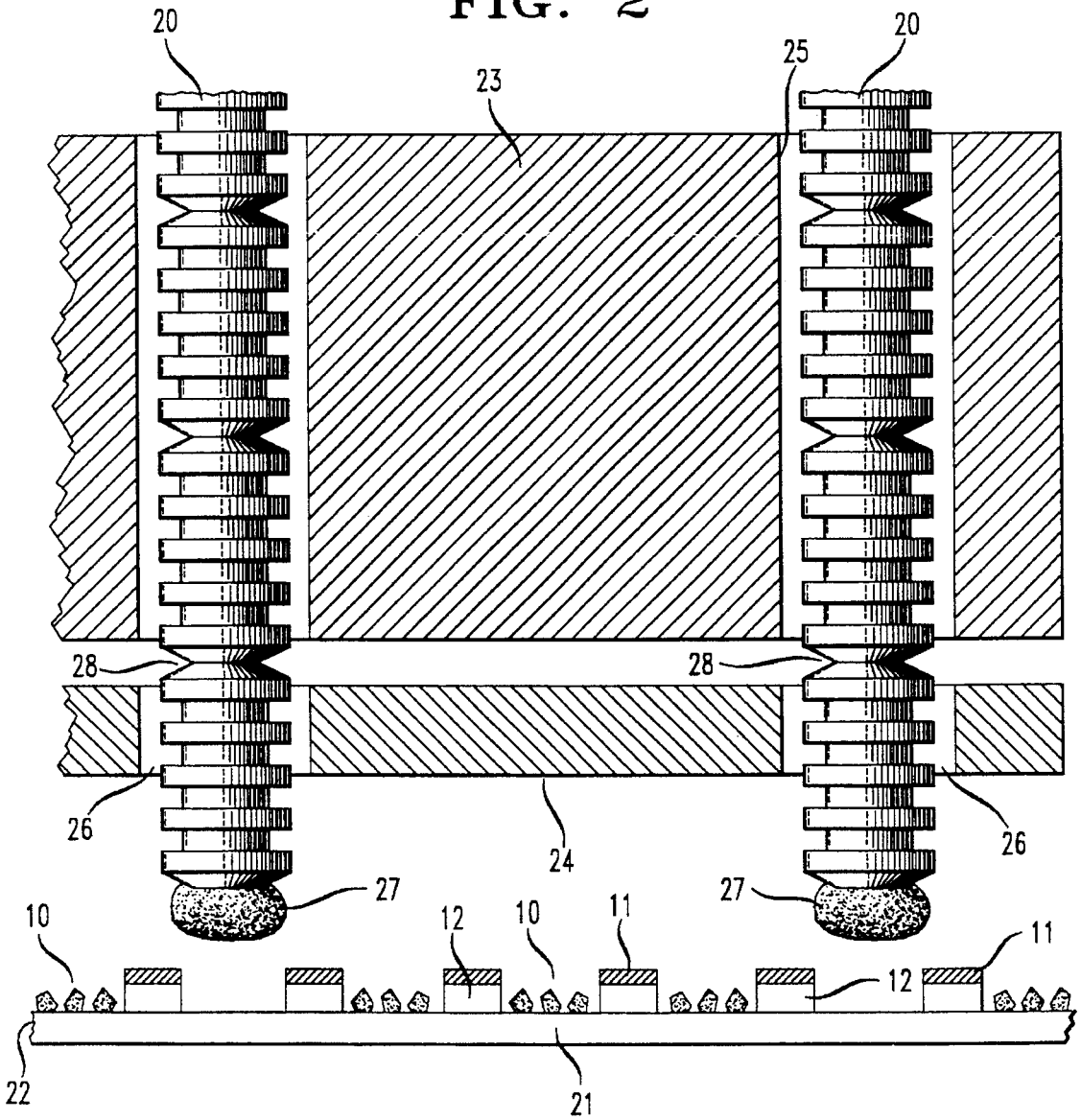
FIG. 2 illustrates apparatus useful in practicing the method of FIG. 1.

After the corrugated rods are formed, the next step shown in FIG. 1, block C, is to adhere the ends of a plurality of rods to an electrode (either cathode or anode) of the field emitting device, preferably the emitting cathode. The placement of pillars on the electrode can be conveniently accomplished by using the apparatus illustrated in FIG. 2. Specifically, a plurality of corrugated rods 20 are applied to an electrode 21 through apertures in a two part template comprising an upper portion 23 and a lower portion 24. In the insertion phase, the apertures 25 and 26 of the upper and lower templates are aligned with each other and with positions on the electrode where pillars are to be adhered. Adhesive spots 27 on the projecting ends of the rods can be provided to unite the rods with electrode 21. Notches 28 are advantageously provided in the rods at desired cutting points. In the example shown, the electrode is the device cathode emitter including emitter regions 10 on conductive substrate 21. Conductive gates 11 are separated from the substrate by an insulating layer 12.

For a FED display requiring 1000 pillars, for example, display—sized templates (e.g., metal sheets with drilled holes at the desired pillar locations), are first prepared. The template holes are simultaneously and continuously supplied with long rods (wires) of corrugated dielectric material. The protruding bottoms of the wires are coated with a material to facilitate bonding, such as adhesive material (e.g. uncured or semicured epoxy), low melting point glass or solder that is molten or in the paste form. Adhesion can be facilitated, if necessary, by locally heating the pillar-to-electrode junction by a laser beam.

The next step shown in Block D of FIG. 1 is to cut the corrugated rods into support pillars. This can be advantageously done by shearing with the apparatus of FIG. 2. The upper template 23 is moved sideways while the lower template 24 is fixed with the adhesive in contact with display cathode surface, so that the bottom pillar is broken away at the pre-designed V-notch location 28. This process is repeated for the next display substrate. As many of the pillars are placed simultaneously, the assembly can be fast and of low cost.

Figure 3:
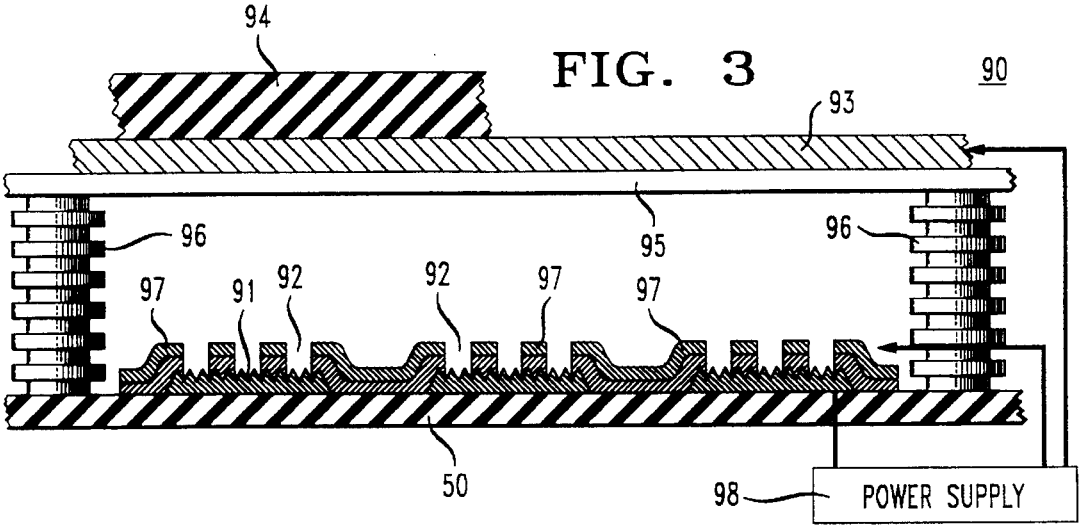
FIG. 3 illustrates an exemplary FED display made by the process of FIG. 1.

The final step of FIG. 1 Block E is to finish the device by applying the other electrode and evacuating the space between the two electrodes. The preferred use of these corrugated pillars is in the fabrication of field emission devices such as electron emission flat panel displays. FIG. 3 is a schematic cross section of an exemplary flat panel display 90 using the high breakdown voltage pillars according to the present invention. The display comprises a cathode 91 including a plurality of emitters 92 and an anode 93 disposed in spaced relation from the emitters within a vacuum seal. The anode conductor 93 formed on a transparent insulating substrate 94 is provided with a phosphor layer 95 and mounted on support pillars 96. Between the cathode and the anode and closely spaced from the emitters is a perforated conductive gate layer 97.

The space between the anode and the emitter is sealed and evacuated, and voltage is applied by power supply 98. The field-emitted electrons from electron emitters 92 are accelerated by the gate electrode 97 from multiple emitters 92 on each pixel and move toward the anode conductive layer 93 (typically transparent conductor such as indium-tin-oxide) coated on the anode substrate 94. Phosphor layer 95 is disposed between the electron emitters and the anode. As the accelerated electrons hit the phosphor, a display image is generated.

II. Corrugated Rod Fabrication

Figure 4:
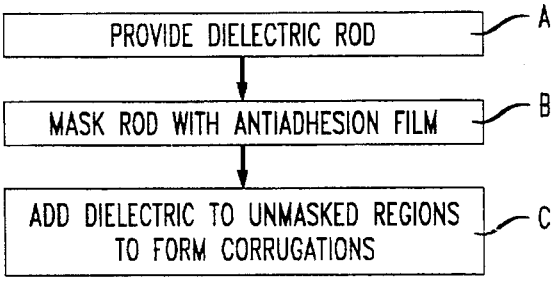
FIG. 4 illustrates a first method for making corrugated rods used in the process of FIG. 1.

FIG. 4 is a flow diagram illustrating the steps involved in a preferred method for creating a corrugated or grooved pillar rod structure. As used herein, the term "corrugated" encompasses a grooved structure. The FIG. 4 method is based on additive processing. The corrugated structure is created by adding extra dielectric material, in a pre-designed fashion, on the surface of the rod, wire or plate-shaped base dielectric material. The term "rod" as used herein encompasses a cylinder, a vertically-oriented plate or any other aperiodic shape used as the base form for a pillar. The first step, block A in FIG. 4, is to provide a rod-shaped dielectric starting material. A long wire in the form of wound spool is a convenient configuration for handling. Optical fiber glass, which is widely used for telecommunications, is easily available, relatively low-cost material with roughly right size and shape, and hence can conveniently be utilized. Other dielectric materials such as polymer wires or, ceramic wires can also be used.

The next step in FIG. 4 (block B) is to apply a patterned, anti-adhesion film (or mask) on the surface of the base wire material, either circumferentially or helically. The anti-adhesion film is exemplarily made of a thin coating of wax, teflon or diamond, applied by any physical, chemical or electro-chemical deposition technique such as spray-coating or dip-coating. Rotation can advantageously be used to assist annular or helical deposition. The desired pitch of the circumferential or helix pattern is typically 10–100 μm for a pillar height of about 300–1000 μm. The patterning can be optionally aided by the use of known mask or photolithography procedures (e.g., exposing rotating wire to a beam of UV light).

The next step (block C in FIG. 4) is to add extra dielectric material to form annular or helical corrugations. This is accomplished, for example, by dip-coating, spray-coating, electrostatic, electrophoretic, or electrochemical deposition on the wire with a slurry, sol-gel precursor, melt, aqueous solution, or dry powder that contains either the dielectric material itself (e.g., powder) or a precursor of the dielectric (the same as the base wire or a different material). Continuously pulling wires through a liquid bath is an advantageous method. The patterned anti-adhesion film ensures the addition of material selectively where the film is not present. A slurry consisting of silica or glass particles with suitable binder and solvent may be coated on the base wire. A water glass (sodium silicate) solution or well-known sol-gel precursor for optical fiber glass may also be used. This process of adding the patterned dielectric material can be repeated if desired to increase the depth of the groove, with optional intermediate or final baking or firing to burn off binder and solvent, and cause strong bonding and densification. Glasses are typically fired at 500°–1000° C. for 0.1–100 hrs. Ceramics and quartz can be sintered or fused typically at 800°–1200° C. for 0.1–100 hrs. Water glass can be dried or baked at lower temperature of below~500 ° C. If the added patterned dielectric material is made of polymer-based liquid or slurry, polymerization or curing either by heat (typically below~300° C. or catalyst, or fusing (in the case of thermoplastic polymer) can be used to densify the material. A careful selection of polymer is needed for the field emission device applications because of the possibility of outgassing in vacuum environment. After the added dielectric coating is solidified and adhered to the base wire, the anti-adhesion film may be optionally dissolved off or burned off, leaving a corrugated pillar structure with increased surface length.

Figure 5A:
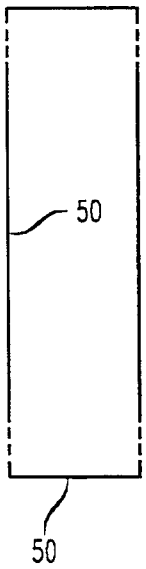
FIG. 5A, 5B and 5C illustrate a rod at various stages of the FIG. 4 process.
Figure 5B:
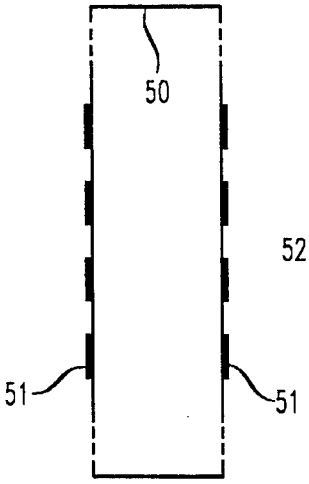
Figure 5C:
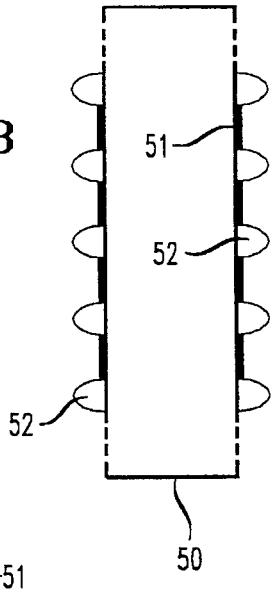
Figure 5D:
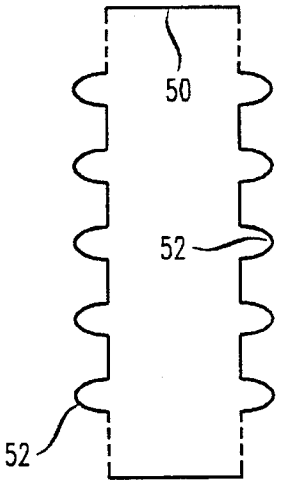

FIGS. 5A, 5B, 5C and 5D illustrate the rod at various stages of fabrication. FIG. 5A shows the cylindrical rod or wire 50 at the outset. FIG. 5B illustrates the rod 50 with the anti-adhesion coating 51 in place. FIG. 5C shows the addition of dielectric corrugations 52 on the portions of rod 50 not covered with coating 51, and FIG. 5D shows the rod with corrugations 52 after the anti-adhesion coating is burned away.

If a deeper groove structure is desired in order to further increase the surface length on the pillar and raise the breakdown voltage, a thicker patterned photoresist mask can be employed in lieu of anti-adhesion coating 51. Photoresist patterning of deep grooved mask with an aspect ratio in excess of 1 is an established technique. The additional dielectric material is added into these deep grooves. Spray-coating, dip-coating, electrostatic or electrophoretic deposition of powders, slurry, sol-gel, melt or aqueous solution containing the desired dielectric material or its precursor can be used, followed by baking or sintering and optional dissolution or pyrolysis of the mask material. The deep-grooved dielectric pillar structure is particularly desirable because not only is the breakdown voltage raised, but the secondary emission electrons can be trapped in the deep groove for improved reliability of the pillar. The desired depth of the groove expressed in terms of the ratio of the groove depth d to the maximum width of the groove opening w, is at least d/w>0.3, and preferably d/w>1.0.

Figure 6:
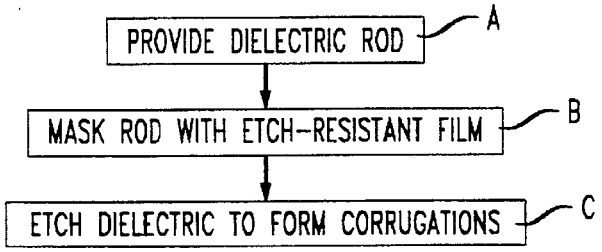
FIG. 6 illustrates a second method for making corrugated rods.

FIG. 6 is a flow diagram for a second method of creating a corrugated (grooved) pillar structure, this method based on subtractive processing. The grooved structure in this case is produced by removing (e.g., by etching away) part of the dielectric material in a pre-designed fashion from the surface of the wire-shaped base dielectric material. The first step, block A in FIG. 6, is to provide a dielectric rod of starting material.

The next step (block B) is to apply a peripherally patterned (e.g. annular or helical), etch-resistant film on the rod surface. Photoresist polymer materials, can be spray-coated or dip-coated and UV patterned. Alternatively, etch-resistant metal (Au or Pt films on glass are relatively resistant to chemical etching by hydrofluoric acid) or ceramic films may be used. These films are physically (as by evaporation or sputtering) or chemically (as by electroless plating or chemical vapor deposition) deposited. They can be patterned either by deposition through a patterned template or by mechanical removal of local regions as by scribing with a sharp-tipped comb.

Figure 7A:
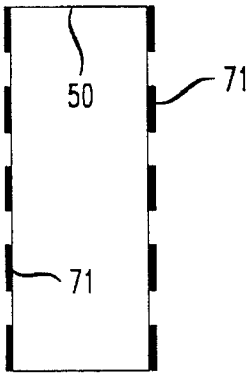
FIG. 7A, 7B and 7C illustrate a rod at various stages of the FIG. 6 process.
Figure 7B:
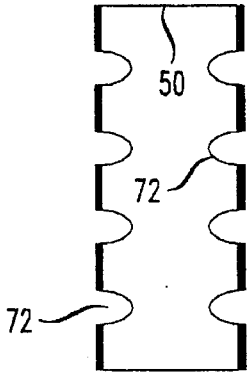
Figure 7C:
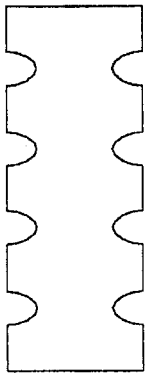

The rod at various stages of the FIG. 6 method is schematically illustrated in FIGS. 7A, 7B and 7C. In FIG. 7A, the etch-resistant film 71 is applied with a desired helical or annular pattern on the surface of the dielectric rod 50, which is then etched (e.g., in HF acid in the case of glass wire, in NaOH in the case of aluminum oxide wire for a suitable time period to obtain etched regions 72 as shown in FIG. 7B. The remnant etch-resistant film 71 is then optionally dissolved, etched or burned off to leave a corrugated, grooved dielectric pillar structure of FIG. 7C. The desired depth of the groove is typically d/w>0.3 and preferably d/w>1.0. The shallower grooves have a generally lenticular shape. The deeper grooves have additional benefit of trapping secondary emission electrons for enhanced reliability of the pillar.

Figure 8:
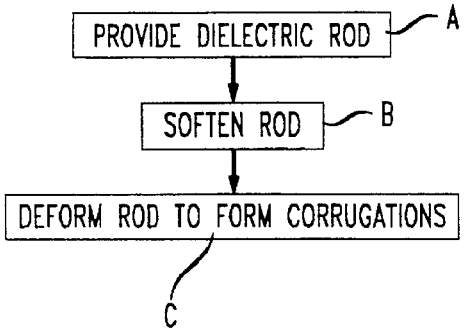
FIG. 8 illustrates a third method for making corrugated rods.

Yet another approach to creating the desired corrugated pillar structure is based on shaping the pillar using predesigned moulds. FIG. 8 is a flow diagram for processing steps using plastic deformation for shaping the pillar. The first step in FIG. 8 (block A) is to provide a rod-shaped dielectric material.

The second step (block B) is to soften the rod, as by applying heat. Lime glass and pyrex glass are softened at temperatures below~900° C. Quartz is softened at>1100° C. Thermoplastic wires are softened at a relatively low temperature of typically below~500° C.

Figure 9:
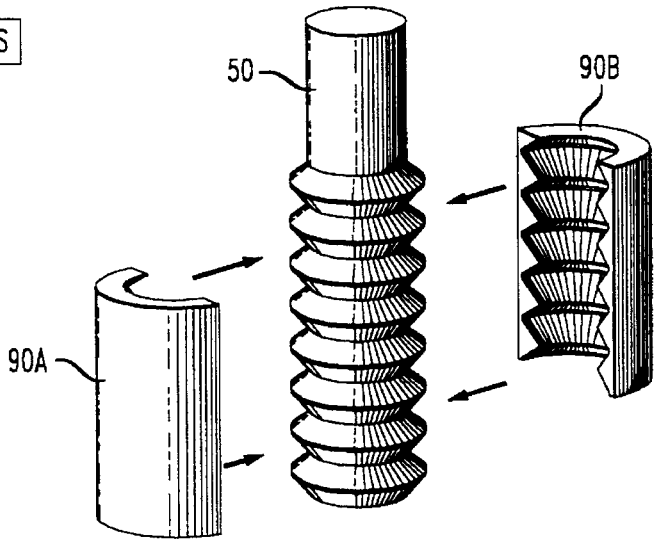
FIG. 9 illustrates apparatus useful in the FIG. 8 process.

The next step in FIG. 8 is to plastically deform the softened rod by mechanical compression with a corrugated die, usually consisting of mating pair, and preferably cooled so that undesirable adhesion between the die and wire is minimized. One exemplary forming die comprising two halves 90A and 90B is schematically illustrated in FIG. 9. A portion of the rod 50 is deformed and moved lengthwise so that the next portion can be deformed.

It is to be understood that the above-described embodiments are illustrative of only a few of the many possible specific embodiments which can represent applications of the principles of the invention. For example, the high breakdown voltage pillars of this invention can be used not only for flat-panel display apparatus but for other applications, such as a x-y matrix addressable electron sources for electron lithography or for microwave power amplifier tubes. Thus numerous and varied other arrangements can be made by those skilled in the art without departing from the spirit and scope of the invention.

We claim:

1. In an electron field emission display device comprising an emitter cathode, an anode and a plurality of insulating pillars spacing apart said cathode and anode, the improvement wherein:

at least one of said insulating pillars has a periodically corrugated outer surface along substantially its entire length for reducing arcing between said cathode and anode along the surface of said pillar.

2. The improved device of claim 1 wherein the corrugations of said pillar are grooves having depth d and maximum width of groove opening w and $d/w>0.3$.

3. The device of claim 2 where $d/w>1.0$.

4. The improved device of claim 1 wherein said insulating pillars are glass fibers.

5. The improved device of claim 1 wherein said corrugations are helical.

6. The improved device of claim 1 wherein said corrugations are annular.

7. The improved device of claim 1 wherein the diameter of said pillar is within the range 50 to 1,000 μm.

8. The improved device of claim 1 wherein said pillar is in the range 300 to 1,000 μm.

9. The improved device of claim 1 wherein the pitch of said corrugations is in the range 10 to 100 μm.

* * * * *